United States Patent [19]

Cooney

[11] Patent Number: 4,879,811

[45] Date of Patent: Nov. 14, 1989

[54] SAFETY RAZOR

[76] Inventor: Daniel J. Cooney, 31360 Old Cannon Rd., Birmingham, Mich. 48010

[21] Appl. No.: 103,836

[22] Filed: Oct. 1, 1987

[51] Int. Cl.[4] ..... B26B 21/14

[52] U.S. Cl. ..... 30/89; 30/87

[58] Field of Search ..... 30/87–89, 30/330, 331; 16/285

[56] References Cited

U.S. PATENT DOCUMENTS

| | | | |
|---|---|---|---|
| 1,719,675 | 7/1929 | Sirch | 30/85 |
| 2,028,011 | 1/1936 | Raymond | 30/85 |
| 2,037,849 | 4/1936 | Brown | 30/85 |
| 2,748,470 | 6/1956 | Borden | 30/89 |
| 3,685,150 | 8/1972 | Risher | 30/74.1 |
| 3,740,841 | 6/1973 | Risher | 30/32 |
| 3,935,639 | 2/1976 | Terry et al. | 30/47 |

FOREIGN PATENT DOCUMENTS

| | | | |
|---|---|---|---|
| 69519 | 7/1949 | Denmark | 30/87 |

*Primary Examiner*—Douglas D. Watts
*Attorney, Agent, or Firm*—Edward J. Timmer

[57] ABSTRACT

The safety razor includes a first handle for gripping by the hand of the person shaving and a second handle carrying a blade head. The handles are hingedly connected by a hinge pin at nested handle ends and a coil or other spring around the hinge pin at the hinge joint biases the second handle in a direction toward the skin of the person shaving. The nested first and second handles are configured adjacent the hinge joint to give the impression of a single handle. Biasing of the second handle adjacent the hinge joint allows erratic or uneven application of the blade head on the face to be accommodated and provides improved control of shaving pressure.

10 Claims, 1 Drawing Sheet

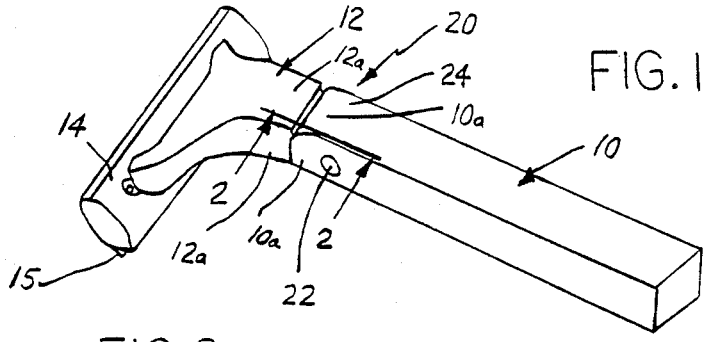
FIG. 1
FIG. 2
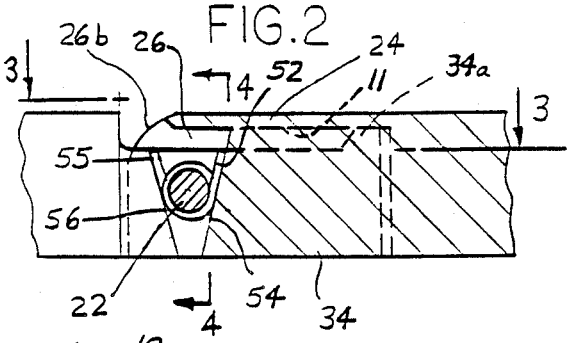
FIG. 3
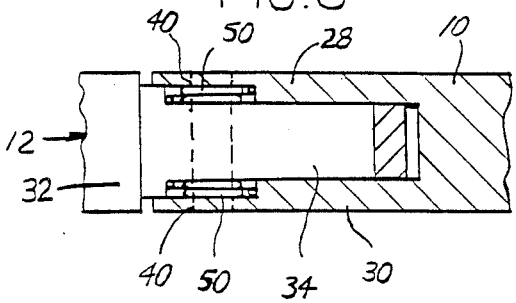
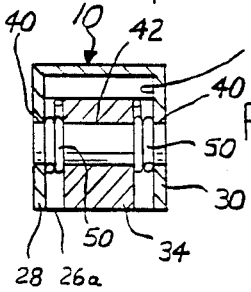
FIG. 4
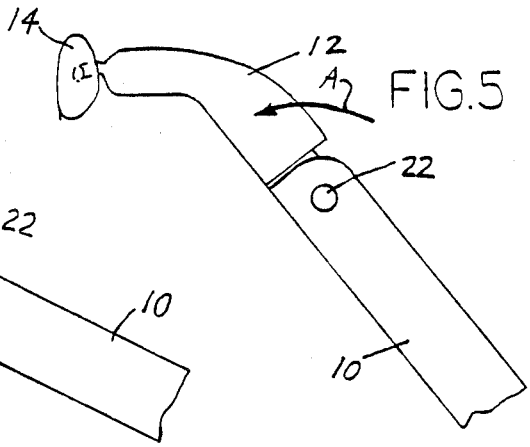
FIG. 5
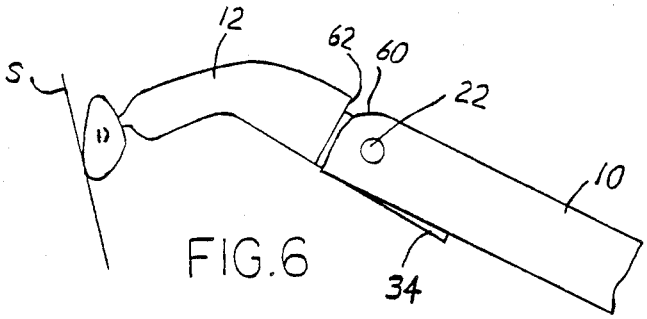
FIG. 6
FIG. 7
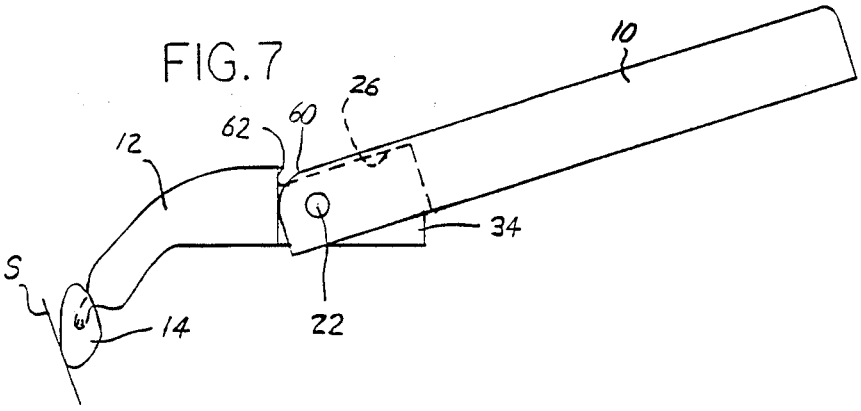

SAFETY RAZOR

FIELD OF THE INVENTION

The invention relates to a safety razor.

DESCRIPTION OF PRIOR ART

U.S. Pat. No. 1,719,675 shows a shaver handle having a coil spring flexibly connecting the handle and a shaver head allowing 360° movement of the shaver head.

U.S. Pat. No. 2,028,011 discloses a shaver construction where a flexible insert of rubber is interposed between a first rigid handle and a second rigid handle portion that is screwed to the shaver head.

U.S. Pat. No. 3,685,150 illustrates a lower rigid handle portion having a blade support assembly (shaver head) pivotally mounted thereon by means of pivot pin for pivoting of the blade support assembly relative to the blade guard. A spring connected between the end of the shaver head and the end of the handle portion biases the shaver head to a first shaving position until pressure of the shaver head on the skin exceeds the spring bias. After that limit is exceeded, the spring allows the shaver head to "float" relative to the blade guard and reduce the shaver head pressure on the skin. The blade guard is stationary relative to the lower rigid handle.

U.S. Pat. No. 3,740,841 provides a handle assembly comprising a handle and pressure guard-carrying member. A blade support assembly (shaver head) is carried on the guard-carrying member and is biased by a leaf spring thereon to a "normal" shaving position. The biasing leaf spring is located on the blade support assembly to allow excessive shaving pressure to be relieved by movement of the blade away from the face if pressure exceeds a preset limit established by the leaf spring.

U.S. Pat. Nos. 2,748,470 and 3,935,639 both show leaf springs to return a pivotably mounted shaver head back to a "normal" or "median" position.

SUMMARY OF THE INVENTION

The invention contemplates a safety razor having a hinge type joint between a first elongate handle and a second elongate handle that carries a blade head and having means for biasing the second handle toward the skin of the person shaving.

The invention also contemplates a safety razor of the type described wherein the first and second handles include nested hingedly connected portions configured to provide the impression of a single handle to the user.

In a typical working embodiment of the invention, the safety razor includes a first elongate handle for gripping by the hand of the person shaving and a second elongate handle carrying a blade head adjacent one end. The second handle is hingedly connected adjacent its other end to the first handle by a hinge pin. One or more coil springs are disposed at the hinge joint around the hinge pin and between the first and second handles to bias the second handle toward the skin of the person shaving. Typically, the first and second handles are nested at the hinge joint in a way to resemble a single handle and to constrain movement of the second handle substantially in a single plane containing both handles and also in a way to limit maximum movement of the second handle away from the face in response to shaving pressure.

BRIEF DESCRIPTION OF THE DRAWINGS

FIG. 1 is a perspective view of a safety razor of the invention.

FIG. 2 is a partial sectional view taken along line 2—2 of FIG. 1.

FIG. 3 is a sectional view taken along line 3—3 of FIG. 2.

FIG. 4 is a sectional view taken along line 4—4 of FIG. 2.

FIG. 5 is a side elevation of the razor with no shaving pressure applied.

FIG. 6 is similar to FIG. 5 showing deflection of the second handle when some shaving pressure is applied to the blade head against the skin of the person shaving.

FIG. 7 is similar to FIG. 6 showing further deflection of the second handle when even more shaving pressure is applied to the blade head against the skin of the person shaving.

BEST MODE FOR PRACTICING THE INVENTION

The safety razor of the invention is shown in FIGS. 1–7 as including a first elongate handle 10 that is adapted to be gripped by the hand of the person shaving and a second elongate handle 12 that carries and supports a blade head 14. Blade head 14 may be fixed in position on handle 12 or may be pivotably supported thereon. Blade head 14 carries metal blade 15.

The first and second handles 10,12 are hingedly connected at hinge joint 20 by a hinge pin 22 extending between the handles at their juncture. In particular, as best shown in FIGS. 2–4, the first handle 10 includes an end 24 having an elongate recess 26 therein extending along the longitudinal axis of the handle. Recess 26 is defined laterally by side walls 28 and 30 on the first handle and has open bottom **26*a* and open front 26*b*. The second handle 12 includes an end 32 with an extension 34 that extends through open front 26*b* of the recess and nests in the recess 26 of the first handle between side walls 28,30. Extension 34 includes stop projection 34*a* to limit movement of handle 12 toward the skin S of the person shaving. Stop 34*a* cooperates with upper inner wall 11 of recess 26 to this end. As is apparent from FIGS. 1 and 5, the configuration of the nested handle ends gives the appearance to the user of a single or unitary handle structure. For example, the cross-sectional profiles of the handle ends adjacent the hinge joint are substantially the same and surfaces 10*a* on handle 10 and surfaces 12*a* on handle 12** are generally contiguous.

Hinge pin 22 extends through a bore 40 in the sidewalls 28,30 and bore 42 in extension 34.

A pair of coil springs 50 are disposed at the hinge joint around the hinge pin adjacent opposite ends thereof. Each coil spring 50 includes one end 52 abutted against an inclined abutment surface 54 on the first handle 10 adjacent or near the hinge joint and another end 55 abutted against an inclined abutment surface 56 on extension 34 of the second handle 12 adjacent or near the hinge joint, see FIG. 2. It is apparent that springs 50 bias the second handle 12 in the direction of arrow A in a counterclockwise direction in FIG. 2. This direction is toward the skin S of the person shaving, see FIGS. 6–7. First handle 10 pivots substantially in a single plane established by hinge pin 22 in bores 40,42 adjacent the hinge joint.

Although two coil springs are illustrated adjacent the hinge joint, it will be apparent that a fewer or greater number of springs may be employed. Also, other types of springs may be used; e.g., leaf springs may be used at or adjacent the hinge joint to effect such biasing.

FIG. 5 illustrates the relative position of the first handle and second handle with no pressure applied by the user on blade head 14 and thus on second handle 12.

FIGS. 6 and 7 illustrate how the second handle 12 deflects against bias of coil springs 50 when shaving pressure is applied.

In FIG. 6, the second handle 12 is shown deflected against bias of springs 50 in the clockwise direction as a result of shaving pressure applied by the person shaving. It is clear that extension 34 has pivoted out of the open bottom 26*a* of recess 26 in the first handle.

FIG. 7 illustrates still further deflection of the second handle 12 under shaving pressure.

During such pivoting movement of the second handle 10, nesting between the side walls 28,30 and extension 34 functions to constrain movement of the second handle in a single pivoting plane established by hinge pin 22 and bores 40,42.

Maximum deflection of the second handle in the clockwise direction is limited by a stop surface 60 on the first handle 10 and a stop surface 62 on the second handle 12. As is apparent, stop surface 62 will eventually abut stop surface 60 upon further deflection. Maximum deflection of the second handle away from the user's face is thereby limited.

When shaving pressure is removed, coil springs 50 return the second handle to the position shown in FIG. 5 relative to the first handle.

The biasing action of springs 50 at or adjacent the hinge joint on the second handle 10 is selected to allow shocks experienced during shaving; i.e., erratic or uneven application of shaving pressure, to be accommodated and also provides a means for the user to exert greater control on the shaving process and shaving pressure. The biasing action allows the blade head and second handle to follow the contour of the skin and allows the user to adjust and control shaving pressure. This biasing action imparts a comfortable action to the safety razor during use that will be appreciated by male and female users.

Those skilled in the ar will appreciate that the location of the hinge joint or connection between the first and second handles can be changed from that shown in FIGS. 1 and 5–7 and still achieve the advantages of the invention.

Handles 10,12, hinge pin 22 and blade carrying head 14 may be made of plastic, metal or other suitable materials to achieve desired structural and aesthetic features for a safety razor.

While the invention has been described by a detailed description of certain specific and preferred embodiments, it is to be understood that various modifications and changes can be made therein within the scope of the appended claims which are intended to include equivalents of such embodiments.

I claim:

1. A safety razor comprising:

a first elongate handle, a second elongate handle having a blade-carrying head adjacent an end thereof and hingedly connected adjacent another end to the first handle to establish a hinge joint between the handles, said handles being configured to nest one inside the other adjacent the hinge joint with the outer of said nested handles having spaced apart side walls and an intermediate wall between the side walls forming an elongate recess for receiving the inner of said handles adjacent said hinge joint, and means for biasing the second handle adjacent the hinge joint toward the skin of the person shaving, said biasing means being disposed in said recess.

2. The razor of claim 1 wherein the biasing means is disposed at the hinge joint substantially concealed in the recess by said side walls and intermediate wall.

3. The razor of claim 1 further including a hinge pin in said recess between the first handle and second handle.

4. The razor of claim 3 wherein the hinge pin is generally perpendicular to the length of the first handle and second handle.

5. The razor of claim 4 wherein the biasing means is disposed between the first and second handle and around the hinge pin with a longitudinal axis of the biasing means substantially parallel to the hinge pin.

6. The razor of claim 5 wherein the biasing means includes a coil spring means around the hinge pin and between the first handle and second handle to bias the second handle toward the skin of the person shaving.

7. The razor of claim 1 where said another end of the second handle is nested in the first handle adjacent the hinge joint to provide an appearance of a single handle.

8. The razor of claim 1 wherein said another end of the second handle is nested in the first handle adjacent the hinge joint and the first handle and second handle have respective exterior surfaces adjacent the hinge joint generally contiguous with one another to provide an appearance of a single handle.

9. The razor of claim 1 further including said side walls on the first handle and sides of said second handle juxtaposed in close relation for constraining movement of the second handle substantially in a single plane.

10. The razor of claim 9 wherein the first handle and second handle include cooperative stop surfaces thereon for engagement with one another to limit maximum movement of the second handle substantially in the single plane away from the skin of the person shaving.

* * * * *